US008522367B2

(12) United States Patent
French et al.

(10) Patent No.: US 8,522,367 B2
(45) Date of Patent: Sep. 3, 2013

(54) GARMENT POCKET FOR CARRYING AN OBJECT IN A CONCEALED STATE

(75) Inventors: Jay French, New Cumberland, PA (US); Jared M. French, New Cumberland, PA (US)

(73) Assignee: CCW Breakaways LLC, New Cumberland, PA (US)

( * ) Notice: Subject to any disclaimer, the term of this patent is extended or adjusted under 35 U.S.C. 154(b) by 807 days.

(21) Appl. No.: 12/430,028

(22) Filed: Apr. 24, 2009

(65) Prior Publication Data

US 2009/0265835 A1 Oct. 29, 2009

Related U.S. Application Data

(60) Provisional application No. 61/048,056, filed on Apr. 25, 2008, provisional application No. 61/048,043, filed on Apr. 25, 2008.

(51) Int. Cl.
*A41D 27/20* (2006.01)

(52) U.S. Cl.
USPC ..... 2/250

(58) Field of Classification Search
USPC ..... 2/114, 247, 248, 249, 250, 251, 252, 2/253, 244, 102; 224/238, 239, 240, 242, 224/243; 206/3, 317
See application file for complete search history.

(56) References Cited

U.S. PATENT DOCUMENTS

| | | | | |
|---|---|---|---|---|
| 309,292 | A | 12/1884 | Browne | |
| 738,168 | A * | 9/1903 | Delavoye | 2/253 |
| 825,189 | A | 7/1906 | Clark et al. | |
| 844,539 | A | 2/1907 | Rosenquist | |
| 1,039,040 | A * | 9/1912 | Elder | 24/3.6 |
| 1,116,643 | A | 11/1914 | Strobel | |
| 1,120,190 | A | 12/1914 | Gaskill | |
| 1,146,685 | A * | 7/1915 | Bernstein | 2/253 |
| 1,161,435 | A * | 11/1915 | Baker | 2/253 |
| 1,191,339 | A | 7/1916 | Noye | |
| 1,212,513 | A * | 1/1917 | Langerman | 2/94 |
| 1,226,640 | A | 5/1917 | Charles | |
| 1,255,497 | A * | 2/1918 | Ankele | 2/254 |
| 1,479,707 | A | 1/1924 | Foisy | |
| 1,582,813 | A | 4/1926 | Ballin | |
| 1,692,200 | A * | 11/1928 | Capuano | 2/249 |
| 1,886,718 | A | 11/1932 | Noel | |
| 1,887,780 | A | 11/1932 | Noel | |
| 1,970,110 | A | 8/1934 | Vaccaro | |
| 2,251,576 | A | 8/1941 | Puodis | |
| 2,262,402 | A | 11/1941 | Oppenheimer | |
| 2,263,546 | A | 11/1941 | Goldsmith et al. | |

(Continued)

*Primary Examiner* — Alissa L Hoey
(74) *Attorney, Agent, or Firm* — McNees Wallace & Nurick LLC

(57) ABSTRACT

A pocket for a garment is disclosed. The pocket comprises a first portion and a second portion connected to the first portion to form a partially-enclosed space. The partially-enclosed space comprises a region defined by (1) a first line corresponding substantially to a line of flexion of a hip joint of a wearer of the garment, (2) a second line corresponding substantially to a centerline of a thigh of a wearer of the garment, and (3) a third line corresponding approximately to an inseam of a wearer of the garment. The region is configured and disposed to substantially conceal an object (e.g., a handgun magazine) retained in the region from a person viewing the garment. The pocket further comprises a retaining device disposed in the region. The retaining device is configured and disposed to hold the object in a fixed position in the region.

26 Claims, 8 Drawing Sheets

(56) References Cited

U.S. PATENT DOCUMENTS 2,283,362 A 5/1942 Hamilton
2,323,390 A 7/1943 Friedman
2,458,353 A * 1/1949 Decker ..... 2/250
2,472,286 A 6/1949 Drasnin
2,489,148 A 11/1949 Ludwig
2,489,868 A 11/1949 Dowling et al.
2,527,224 A 10/1950 Landy
2,530,453 A * 11/1950 Eagle ..... 2/247
2,557,445 A 6/1951 Lewallen
2,593,795 A 4/1952 Rhoads et al.
2,604,627 A 7/1952 Abbott
2,671,902 A * 3/1954 Grue ..... 40/586
2,705,326 A 4/1955 Lahnstein et al.
2,732,560 A 1/1956 Frederiksen, Sr.
2,810,132 A 10/1957 Nicholson
2,899,684 A 8/1959 Riley
3,000,012 A 9/1961 Neil
3,072,917 A * 1/1963 Watson, Jr. ..... 2/279
3,077,604 A 2/1963 Colangelo
3,137,866 A 6/1964 Stephens, Jr.
3,212,689 A * 10/1965 Woolfolk ..... 206/3
3,220,017 A 11/1965 Morton
3,374,508 A * 3/1968 Slimovitz ..... 24/3.1
3,537,108 A 11/1970 Daniels
3,611,444 A * 10/1971 Rector ..... 2/227
3,627,181 A * 12/1971 Bianchi ..... 224/150
3,723,994 A 4/1973 Tucker
3,751,731 A 8/1973 Bennett
3,782,614 A 1/1974 Campisi
4,077,067 A 3/1978 Kozdal
4,123,804 A 11/1978 Michael et al.
4,138,745 A 2/1979 Greenspan
4,149,275 A 4/1979 Sanchez
4,156,295 A 5/1979 LeRoy
4,200,938 A 5/1980 Letourneau
4,235,356 A 11/1980 Atchisson
4,262,832 A * 4/1981 Perkins ..... 224/605
4,318,503 A 3/1982 Capano
4,334,326 A * 6/1982 Mallow ..... 2/249
4,386,642 A * 6/1983 Durbin ..... 190/110
4,389,801 A * 6/1983 Sharrock et al. ..... 40/775
4,463,847 A * 8/1984 Gordon ..... 206/205
4,532,656 A * 8/1985 Suzuki ..... 2/247
4,541,556 A * 9/1985 Collins et al. ..... 224/196
4,602,390 A * 7/1986 Morera et al. ..... 2/251
4,637,075 A 1/1987 Ingrisano et al.
4,651,355 A 3/1987 White
4,672,721 A 6/1987 Provost
4,710,979 A * 12/1987 Bull et al. ..... 2/48
4,741,465 A 5/1988 Johnson
4,791,681 A 12/1988 Dean
4,843,649 A * 7/1989 Jewell et al. ..... 2/94
4,846,383 A * 7/1989 Gallagher ..... 224/243
4,877,131 A * 10/1989 Patros et al. ..... 206/317
4,882,786 A 11/1989 Gross
4,898,310 A 2/1990 Remington
4,899,395 A * 2/1990 Spector ..... 2/250
4,966,320 A 10/1990 DeSantis et al.
4,966,321 A 10/1990 Outlaw
4,989,273 A * 2/1991 Cromartie ..... 2/231
4,998,654 A 3/1991 Bruzek et al.
5,054,127 A * 10/1991 Zevchak ..... 2/247
5,054,671 A 10/1991 Else
5,067,178 A * 11/1991 Katchka ..... 2/250
5,082,157 A 1/1992 Emerson-Santos
5,127,565 A * 7/1992 Grant ..... 224/196
5,152,442 A * 10/1992 Gallagher ..... 224/245
5,172,683 A * 12/1992 West ..... 126/263.05
5,215,238 A 6/1993 Baruch
5,221,031 A * 6/1993 Prigmore ..... 224/267
5,285,312 A * 2/1994 Mastro ..... 359/516
5,294,031 A * 3/1994 Volpei et al. ..... 224/682
5,397,040 A * 3/1995 Lee ..... 224/679
5,400,438 A * 3/1995 Staff et al. ..... 2/129
5,419,474 A 5/1995 Marx et al.
5,421,032 A 6/1995 Murphy
5,445,303 A 8/1995 Cawile, Jr.
5,451,725 A * 9/1995 Goldman ..... 181/131
5,460,188 A * 10/1995 Barrett, Sr. ..... 128/842
5,495,967 A * 3/1996 Parton ..... 224/610
5,535,453 A 7/1996 Howard
5,539,932 A 7/1996 Howard
5,542,122 A * 8/1996 Moldovan ..... 2/69
5,555,566 A 9/1996 Kuhn
5,573,441 A * 11/1996 Smith ..... 450/89
5,584,424 A * 12/1996 Stava ..... 224/240
5,588,154 A 12/1996 Blauer et al.
5,638,549 A 6/1997 Thomas
5,662,219 A * 9/1997 Tschudy et al. ..... 206/317
5,692,237 A 12/1997 Bennett
5,708,978 A * 1/1998 Johnsrud ..... 2/102
5,749,098 A 5/1998 Evans
5,771,496 A 6/1998 Wood
5,800,900 A * 9/1998 Mitchell ..... 428/100
5,809,576 A * 9/1998 Huston et al. ..... 2/247
5,829,653 A * 11/1998 Kaiser ..... 224/577
5,832,536 A 11/1998 Kramer
5,832,540 A * 11/1998 Knight ..... 2/247
5,884,338 A 3/1999 Golde
5,901,372 A * 5/1999 Lawler ..... 2/69
5,909,834 A * 6/1999 Parrott, III ..... 224/587
5,924,565 A * 7/1999 Colee ..... 206/317
5,931,358 A 8/1999 Rogers
5,940,883 A 8/1999 Daoust
5,953,757 A * 9/1999 Blanks ..... 2/243.1
5,991,925 A * 11/1999 Wu ..... 2/102
6,076,715 A * 6/2000 Easter ..... 224/149
6,079,049 A * 6/2000 Moir ..... 2/69
6,082,600 A * 7/2000 Angus et al. ..... 224/269
6,105,170 A * 8/2000 Lisciandro et al. ..... 2/102
6,131,198 A 10/2000 Westrick
6,154,888 A 12/2000 Krohn
6,176,407 B1 * 1/2001 Jones et al. ..... 224/584
6,199,218 B1 * 3/2001 Michael ..... 2/247
6,244,400 B1 * 6/2001 Bowers ..... 190/110
6,264,079 B1 7/2001 Skaggs
6,286,736 B1 * 9/2001 Angus et al. ..... 224/269
6,318,613 B1 * 11/2001 Underhill ..... 224/587
6,374,421 B1 * 4/2002 Cleary ..... 2/254
6,547,070 B1 * 4/2003 Kolpin ..... 206/317
6,547,111 B2 4/2003 French
6,671,887 B1 * 1/2004 Eligan et al. ..... 2/228
6,685,066 B2 2/2004 Cragg
6,760,922 B1 * 7/2004 Morales ..... 2/94
6,763,527 B1 7/2004 Rivoli et al.
6,769,139 B1 8/2004 Goldkind
6,820,281 B2 * 11/2004 Mariland et al. ..... 2/115
6,874,618 B1 * 4/2005 Cragg ..... 206/3
6,926,182 B2 8/2005 Cragg
6,978,484 B2 12/2005 Donlan et al.
6,986,164 B1 1/2006 Morales
7,003,810 B2 2/2006 Goldkind
7,058,987 B2 6/2006 Salazar
7,152,247 B2 12/2006 Parsons
7,152,248 B2 * 12/2006 Ziemer ..... 2/160
7,216,404 B1 * 5/2007 Doyle ..... 24/573.11
7,571,495 B2 * 8/2009 Emeth ..... 2/244
7,631,368 B1 12/2009 Samson
7,636,949 B1 12/2009 Shooshan
7,637,218 B1 12/2009 Burton
7,681,255 B2 3/2010 Morales et al.
7,743,430 B2 6/2010 Jennings et al.
7,753,759 B2 * 7/2010 Pintor et al. ..... 450/89
7,918,371 B2 * 4/2011 Wilson ..... 224/196
8,060,948 B2 * 11/2011 Pesic ..... 2/161.5
8,302,827 B1 * 11/2012 Cole ..... 224/243
8,307,465 B2 11/2012 French et al.
2003/0182714 A1 * 10/2003 Mariland et al. ..... 2/247
2003/0205595 A1 11/2003 Young
2005/0015844 A1 1/2005 Parsons
2005/0017034 A1 1/2005 Ausanio
2005/0066424 A1 3/2005 Salazar
2005/0198872 A1 * 9/2005 Correa ..... 36/136
2005/0223466 A1 10/2005 Jennings et al.

2005/0235398 A1 10/2005 Yoo
2006/0015987 A1* 1/2006 Anderson ..... 2/247
2007/0000965 A1* 1/2007 Cannon, Jr. ..... 224/673
2007/0245444 A1* 10/2007 Brink ..... 2/69
2007/0250980 A1 11/2007 Pellerin
2007/0254129 A1* 11/2007 Horblitt ..... 428/42.3
2008/0006659 A1* 1/2008 Cain ..... 224/222
2008/0125842 A1 5/2008 Petitt
2008/0163407 A1* 7/2008 Gardner ..... 2/209.13
2008/0184459 A1* 8/2008 Barnes ..... 2/249
2008/0263742 A1 10/2008 Vaughn
2009/0025117 A1 1/2009 French
2009/0172861 A1 7/2009 Tomlinson et al.
2009/0265835 A1 10/2009 French et al.
2009/0293170 A1* 12/2009 Kiker ..... 2/84
2010/0017943 A1 1/2010 Morales et al.
2010/0050312 A1 3/2010 French et al.
2010/0319108 A1 12/2010 King
2011/0030126 A1 2/2011 French
2011/0119800 A1 5/2011 Garrido et al.

* cited by examiner

GARMENT POCKET FOR CARRYING AN OBJECT IN A CONCEALED STATE

CROSS-REFERENCE TO RELATED APPLICATIONS

This application claims the benefit of U.S. Provisional Application No. 61/048,056, filed Apr. 25, 2008, and U.S. Provisional Application No. 61/048,043, filed Apr. 25, 2008.

FIELD OF THE INVENTION

The present invention is directed to a garment pocket and, more specifically, to a garment pocket that is configured to carry, in a concealed and readily-accessible state, an extra handgun magazine or other relatively small object (e.g., bullets, pepper spray, pocket tool, handcuffs, dagger, etc.). Another embodiment of the garment pocket disclosed herein is configured to carry, in a concealed and readily-accessible state, both a handgun (or similar object) and an extra handgun magazine (or other relatively small object).

BACKGROUND OF THE INVENTION

Law-enforcement personnel are usually authorized to carry protection devices (e.g., handguns, stun guns, etc.) and/or related accessories (e.g., extra handgun magazines, extra bullets, pepper sprays, pocket tools, handcuffs, daggers, etc.). However, when working undercover or on duty in plain clothes, law-enforcement personnel can have a problem with telegraphing, which is sometimes referred to as "profiling" or "mapping." As used broadly herein, "telegraphing" is the tendency for a concealed object (e.g., an extra handgun magazine) to show through the concealing garment, rendering it readily detectable by others. Known carrying devices worn by law-enforcement personnel do not sufficiently minimize telegraphing. Furthermore, when the law-enforcement officer or wearer is wearing only one or two layers of clothing, such as when the wearer is dressed appropriately for warm weather or for working indoors in a temperature-controlled environment, the presence of the carrying device becomes even more evident. In many instances, the carrying device, itself, will telegraph the potential presence of the object(s).

Accordingly, what is needed is a garment pocket that is configured to carry, in a concealed and readily-accessible state, an extra handgun magazine or other relatively small object (e.g., bullets, pepper spray, pocket tool, handcuffs, dagger, etc.). Additionally, there is a need for a garment pocket that is configured to carry, in a concealed and readily-accessible state, both a handgun (or similar object) and an extra handgun magazine (or other relatively small object).

SUMMARY OF THE INVENTION

In accordance with one aspect of the present invention, a pocket for a garment is disclosed. The pocket comprises a first portion and a second portion connected to the first portion to form a partially-enclosed space. The partially-enclosed space comprises a region defined by (1) a first line corresponding substantially to a line of flexion of a hip joint of a wearer of the garment, (2) a second line corresponding substantially to a centerline of a thigh of a wearer of the garment, and (3) a third line corresponding approximately to an inseam of a wearer of the garment. The region is configured and disposed to substantially conceal an object (e.g., a handgun magazine) retained in the region from a person viewing the garment. The pocket further comprises a retaining device disposed in the region. The retaining device is configured and disposed to hold the object in a fixed position in the region.

In accordance with another aspect of the present invention, a garment for a person is disclosed. The garment comprises a pocket, which comprises a first portion and a second portion connected to the first portion to form a partially-enclosed space. The partially-enclosed space comprises a region defined by a first line corresponding substantially to a line of flexion of a hip joint of a wearer of the garment, a second line corresponding substantially to a centerline of a thigh of a wearer of the garment, and a third line corresponding approximately to an inseam of a wearer of the garment. The region is configured and disposed to substantially conceal an object retained in the region from a person viewing the garment. The pocket further comprises (1) a retainer configured to releasably retain an object, and (2) an attachment zone disposed in the region. The attachment zone is configured and disposed to releasably hold the retainer in a fixed position in the region.

In accordance with yet another aspect of the present invention, a method of making a garment for a person is disclosed. The method comprises providing at least one sheet of material. The method further comprises forming a pocket having an opening and a partially-enclosed space from the at least one sheet of material. The partially-enclosed space comprises a region defined by a first line corresponding substantially to a line of flexion corresponding to a hip joint of a wearer of the garment, a second line corresponding substantially to a centerline of a thigh of the wearer of the garment, and a third line corresponding approximately to an inseam of a wearer of the garment. The region is configured and disposed to substantially conceal an object disposed in the region from a person viewing the garment. The method further comprises attaching a retaining device to the region. The retaining device is configured and disposed to hold an object in a fixed position in the region. Additionally, the method comprises attaching the pocket to the garment.

In accordance with yet another aspect of the present invention, a system for carrying a handgun and a handgun magazine in a garment is disclosed. The system comprises a pocket to be attached to a garment, the pocket comprising a first portion and a second portion connected to the first portion to form a first partially-enclosed space. The first partially-enclosed space comprises a first region to store a handgun and a second region to store a handgun magazine. The first region is defined by a first line corresponding substantially to a line of flexion of a hip joint of a wearer of the garment, a second line corresponding substantially to a centerline of a thigh of a wearer of the garment, a third line corresponding approximately to an inseam of a wearer of the garment, and a fourth line corresponding substantially to a line of flexion of a knee joint of a wearer of the garment. The second region, which is defined by the first line, the second line, and the third line, is configured and disposed to substantially conceal a handgun magazine retained in the second region from a person viewing the garment. The pocket further comprises an inner edge to be disposed proximate to an inseam of the garment, a base intersecting the inner edge, and a seam disposed adjacent to the region, the seam extending substantially parallel to the inner edge for a predetermined distance. The base, the inner edge, and the seam define a first zone in the first region to receive a portion of a handgun. The first zone is configured to position a barrel of the handgun adjacent to the inner edge, to position a muzzle of the handgun substantially adjacent to the base, and to position a trigger guard of the handgun proximate to an end of the seam opposite the base. The seam and the inner edge are configured and disposed to restrict lateral movement of the handgun when positioned in the first zone. A retaining device is disposed in the second region, and is configured and disposed to hold a handgun magazine in a fixed position in the second region.

Among the advantages of the present invention are that it enables the wearer to carry, in a concealed and readily-accessible state, an extra handgun magazine or other relatively small object (e.g., bullets, pepper spray, pocket tool, handcuffs, dagger, etc.). The present invention minimizes telegraphing of the extra handgun magazine or other object and also renders it extremely difficult for a person other than the wearer to access the handgun magazine or other object carried therein without the wearer's knowledge. Additionally, it is difficult for the wearer to lose possession of the handgun magazine or other object carried therein, including even while the wearer is engaging in strenuous physical activity (e.g., fighting, running, jumping). The present invention does not significantly compromise the wearer's freedom of movement because the handgun magazine or other object does not intersect (1) the line of flexion of the wearer's hip joint or (2) the line of flexion of the wearer's knee joint. For example, the ability of the wearer to kneel, run, and sit is not significantly compromised. The wearer also benefits from having "constant recognition" or "constant feel" that the handgun magazine or other object is on his person because it is carried adjacent to his inner thigh, increasing the possibility that the wearer would notice if it went missing.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers are used throughout the drawings to refer to the same or like parts.

DETAILED DESCRIPTION OF THE INVENTION

Figure 1A:
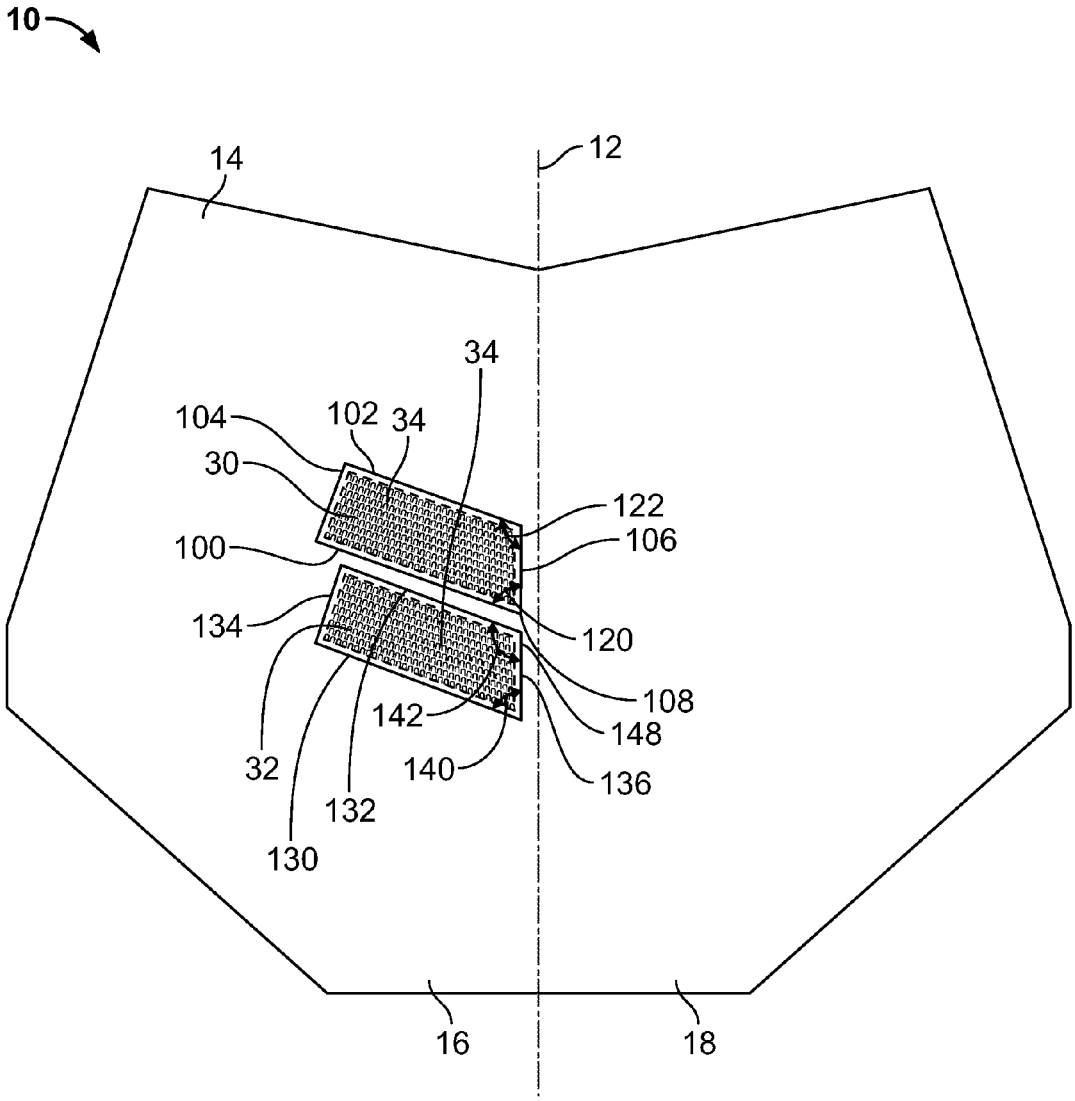
FIG. 1A is a schematic front plan view of an unsewn exemplary embodiment of the garment pocket of the present invention.
Figure 1B:
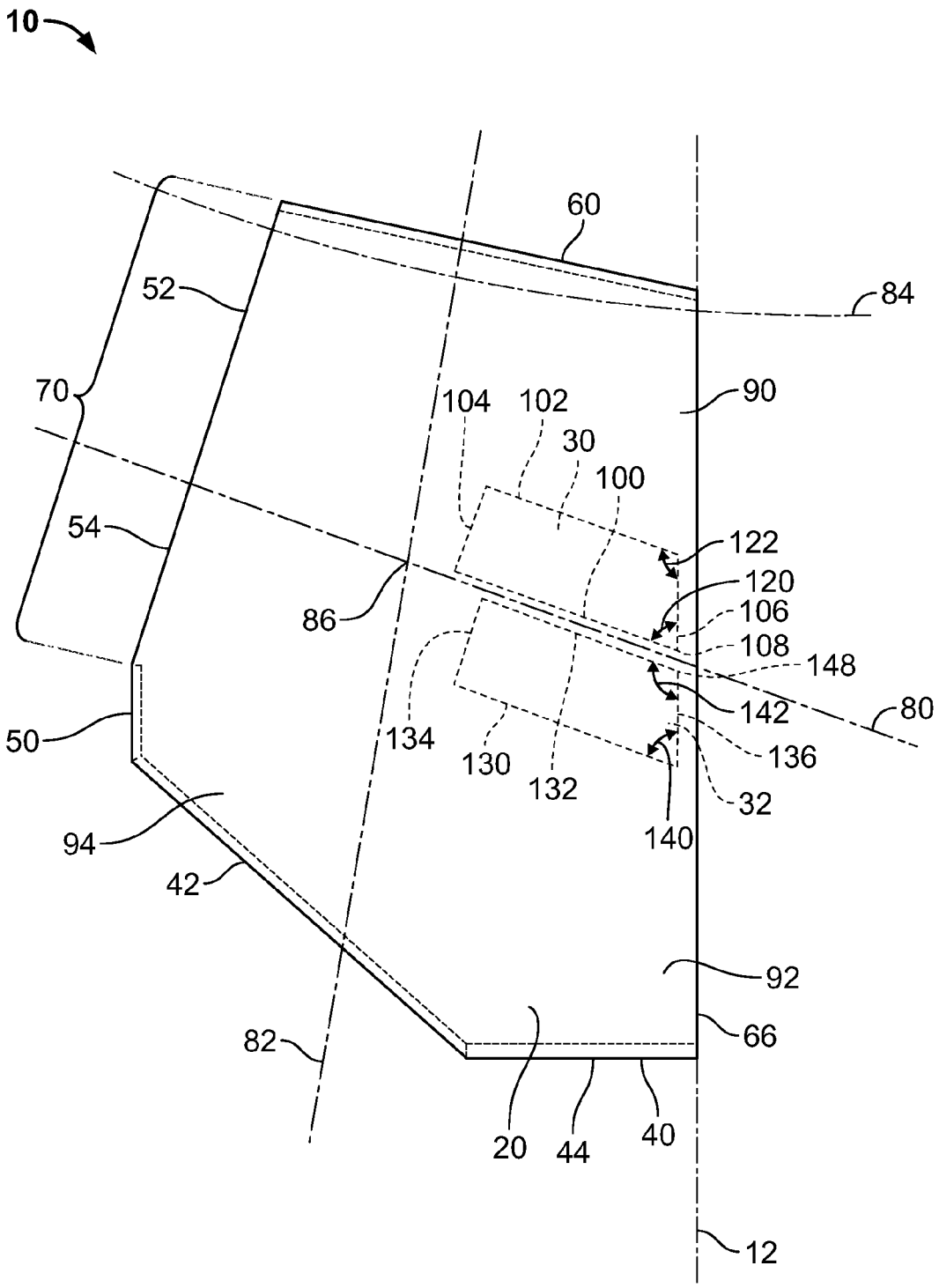
FIG. 1B is a schematic front plan view of a sewn exemplary embodiment of the garment pocket of the present invention.

FIGS. 1A and 1B show different views of an exemplary embodiment of the garment pocket of the present invention. Pocket 10, which is shown configured for access by a wearer's right hand, is intended for incorporation into a garment (e.g., pants, shorts, skirts). In another embodiment, pocket 10 can be configured for access by a wearer's left hand. For illustrative purposes, FIG. 1A shows pocket 10 before the actual pocket is formed, and FIG. 1B shows pocket 10 after the actual pocket has been formed, such as by stitching, sewing, or other suitable techniques. As shown in FIGS. 1A and 1B, pocket 10 can be formed, for example, by folding a single sheet of pliable material 14 along axis 12. Suitable examples of a pliable material include, without limitation, cotton, twill, ripstop cloth, and ripstop nylon. In an alternate embodiment, pocket 10 can be manufactured using two or more pieces of pliable material. Referring to FIG. 1A, first section 16 of pliable material 14, which is defined in part by axis 12, serves as the inner portion or part of pocket 10, i.e., the part of pocket 10 that is intended to be in closest proximity to the wearer's body. Second section 18 of pliable material 14, which is defined in part also by axis 12, serves as outer portion or part 20 (see FIG. 1B) of pocket 10. Outer part 20 is shown in FIG. 1B, but the inner part is not, because outer part 20 and the inner part are substantially congruent in this exemplary embodiment. Upon formation of the actual pocket, as shown in FIG. 1B, the surface of first section 16 shown in FIG. 1A serves as a first interior surface of pocket 10, and the surface of second section 18 shown in FIG. 1A serves as an (opposing) second interior surface of pocket 10. These two opposing interior surfaces border the partially enclosed space defined by the pocket 10.

As shown in FIG. 1A, the first interior surface of pocket 10 includes a first attachment zone 30 and a second attachment zone 32. First attachment zone 30 and a retainer 160 (see FIGS. 2A, 2B, and 2D) are mutually configured to enable retainer 160 to be releasably attached, removed and reattached multiple times to the first interior surface of pocket 10. In another embodiment, first attachment zone 30 is included instead on the opposing second interior surface. As shown in FIG. 1A, first attachment zone 30 includes loop-type fasteners 34 to enable releasable attachment to retainer 160, by way of corresponding hook-type fasteners 214 on retainer 160 (see FIG. 2D). Hook and loop-type fastener systems marketed under the trademark Velcro® are among those that are suitable for use in this invention. Other readily-releasable fastener systems, including (without limitation) snaps or adhesives, may be used instead of, or in combination with, hook and loop-type fastener systems. In this exemplary embodiment, loop-type fasteners 34, as opposed to hook-type fasteners 214, are present on first attachment zone 30 because loop-type fasteners are generally less abrasive than hook-type fasteners. Thus, when pocket 10 is being used without retainer 160, the wearer may experience less discomfort from contact with loop-type fasteners 34 when inserting (or withdrawing) a hand in (or from) pocket 10. In an alternate embodiment, hook-type fasteners can be used on first attachment zone 30 and loop-type fasteners can be used on retainer 160. Alternatively, a non-hook and loop-type fastener system (e.g., snaps) may be used in first attachment zone 30 and retainer 160.

Second attachment zone 32 and retainer 160 (see FIGS. 2A-2D) are mutually configured to enable retainer 160 to be releasably attached, removed, and reattached to the first interior surface of pocket 10. The structure and function of second attachment zone 32 is similar to the structure and function of first attachment zone 30, and the variations in structure described above in relation to first attachment zone 30 are equally applicable to second attachment zone 32. In another embodiment, second attachment zone 32 is included instead on the opposing second interior surface. In the exemplary embodiment shown in FIGS. 1A and 1B, first attachment zone 30 is substantially identical in size to second attachment zone 32. However, in other embodiments, first attachment zone 30 and second attachment zone 32 may have different sizes. The exemplary embodiment shown in FIGS. 1A and 1B is configured to enable the releasable attachment of two retainers 160, each of which is configured to retain therein a handgun magazine, such as that shown in FIG. 2B, or other item. In other exemplary embodiments, pocket 10 can include one attachment zone or three or more attachment zones.

Referring to FIG. 1B, outer part 20 is fastened (e.g., seamed or sewn) to the corresponding inner part at least along (1) first segment 40 and second segment 42 of base edge 44, (2) segment 50 of outer edge 54, and (3) top edge 60. In another embodiment, outer part 20 and the corresponding inner part may be derived from two or more pieces of pliable material. In embodiments using two or more pieces of pliable material, outer part 20 is additionally fastened to the corresponding inner part along inner edge 66.

In pocket 10, outer part 20 and the corresponding inner part can be fastened to the waistline of the garment along top edge 60. As used herein, "waistline" is defined as the part of a garment that generally covers the waistline of the person and/or an adjoining area above or below the waistline. Similarly, the corresponding inner part (but not outer part 20) is intended to be fastened to the garment along segment 52 of outer edge 54, which coincides with pocket opening 70. Both outer part 20 and the corresponding inner part are intended to be fastened to the garment along segment 50 of outer edge 54. As exemplified by pocket 10, segment 50 can be used to maintain pocket 10 in a proper position following incorporation into the garment, especially as pocket 10 is generally not fastened to the garment along inner edge 66 or base edge 44.

Pocket 10 can be incorporated into a garment (e.g., pants) such that pocket 10 is oriented as shown in FIG. 1B. Line 80 through pocket 10 represents approximately the line of flexion corresponding to the wearer's hip joint. Line 82 through pocket 10 represents approximately the centerline of the wearer's thigh. Line 84 through pocket 10 represents approximately the wearer's waistline. Origin point 86 is defined by the intersection of line 80 and line 82.

Assuming that line 80 and line 82 correspond respectively to the x-axis and y-axis of a Cartesian coordinate system, pocket 10 can be considered as having four quadrant-like regions, three of which are described below. A first region 90 is defined by (1) the line of flexion corresponding to the wearer's hip joint (i.e., line 80); (2) the centerline of the wearer's thigh (i.e., line 82); (3) inner edge 66 of pocket 10, which corresponds approximately to the line defined by the wearer's inseam; and (4) line 84, which corresponds approximately to the wearer's waistline. A second region 92 is defined by (1) the line of flexion corresponding to the wearer's hip joint (i.e., line 80); (2) the centerline of the wearer's thigh (i.e., line 82); (3) inner edge 66 of pocket 10, which corresponds approximately to the line defined by the wearer's inseam; and (4) base edge 44, which is located above the line of flexion corresponding to the wearer's knee joint, and includes first segment 40. A third region 94 is defined by (1) the line of flexion corresponding to the wearer's hip joint (i.e., line 80); (2) the centerline of the wearer's thigh (i.e., line 82); (3) outer edge 54; and (4) second segment 42 of base edge 44.

First attachment zone 30 can be located in first region 90 of pocket 10. As shown in the exemplary embodiment, first attachment zone 30 is located adjacent to line 80, which corresponds to the line of flexion corresponding to the wearer's hip joint, and adjacent to inner edge 66, which corresponds approximately to the line defined by the wearer's inseam. In other embodiments, first attachment zone 30 may be located elsewhere in first region 90, provided first attachment zone 30 does not intersect line 80 or line 82. Also, as shown in FIGS. 1A and 1B, the shape of first attachment zone 30 is a right-angled trapezoid, rendering first attachment zone 30 substantially congruent to retainer 160 shown in FIGS. 2A, 2B, and 2D, thereby providing guidance to the wearer as he seeks to mate hook-type fasteners 214 of retainer 160 with loop-type fasteners 34 of first attachment zone 30 and fix retainer 160 in proper position and orientation in first region 90. In other embodiments, first attachment zone 30 and retainer 160 are not substantially congruent, but still have the requisite and respective fastening (or mating) portions to enable releasable attachment, removal and reattachment multiple times. First attachment zone 30 has two substantially parallel sides: first parallel side 100 and second parallel side 102. Additionally, first attachment zone 30 has a perpendicular side 104, which is perpendicular to first parallel side 100 and to second parallel side 102, and a non-perpendicular side 106. First parallel side 100 and non-perpendicular side 106 meet at an acute angle 120, and second parallel side 102 and non-perpendicular side 106 meet at an obtuse angle 122. First attachment zone 30 is oriented such that non-perpendicular side 106 is substantially parallel to inner edge 66, and first parallel side 100 is substantially parallel to line 80. Additionally, first attachment zone 30 is oriented such that vertex 108 of acute angle 120 is proximate to the intersection of line 80 and inner edge 66. In the exemplary embodiment, acute angle 120 is approximately seventy degrees (70°). An acute angle 120 of approximately seventy degrees (70°) aligns retainer 160, such that retainer opening 190 is directed toward pocket opening 70, thereby facilitating removal, by the wearer, of the object (e.g., handgun magazine) retained in retainer 160. Depending on the application and/or the location of first attachment zone 30 in first region 90, however, acute angle 120 may range from approximately forty-five degrees (45°) to approximately eighty-five degrees (85°) and, more preferably, from approximately sixty degrees (60°) to approximately eighty degrees (80°). Acute angle 120 may also vary with the configuration of pocket opening 70.

Second attachment zone 32 is located in second region 92 of pocket 10. As shown in the exemplary embodiment, second attachment zone 32 is located adjacent to line 80, which corresponds to the line of flexion corresponding to the wearer's hip joint, and adjacent to inner edge 66, which corresponds approximately to the line defined by the wearer's inseam. In other embodiments, second attachment zone 32 may be located elsewhere in second region 92, provided second attachment zone 32 does not intersect line 80 or line 82. Also, as shown in the exemplary embodiment, the shape of second attachment zone 32 is a right-angled trapezoid, rendering second attachment zone 32 substantially congruent to first attachment zone 30 and retainer 160, thereby providing guidance to the wearer as he seeks to mate hook-type fasteners 214 of retainer 160 with loop-type fasteners 34 of second attachment zone 32 and fix retainer 160 in proper position and orientation in second region 92. In other embodiments, second attachment zone 32 and retainer 160 are not substantially congruent, but still have the requisite and respective fastening (or mating) portions to enable releasable attachment, removal and reattachment multiple times. Accordingly, second attachment zone 32 has two substantially parallel sides: first parallel side 130 and second parallel side 132. Additionally, second attachment zone 32 has a perpendicular side 134, which is perpendicular to first parallel side 130 and to second parallel side 132, and a non-perpendicular side 136. First parallel side 130 and non-perpendicular side 136 meet at an acute angle 140, and second parallel side 132 and non-perpendicular side 136 meet at an obtuse angle 142. Second attachment zone 32 is oriented such that non-perpendicular side 136 is substantially parallel to inner edge 66, and second parallel side 132 is substantially parallel to line 80. Additionally, second attachment zone 32 is oriented such that vertex 148 of obtuse angle 142 is proximate to the intersection of line 80 and inner edge 66. In other embodiments, the shapes of first and/or second attachment zones 30, 32 vary depending on the application. First and/or second attachment zones 30, 32 for use in carrying handcuffs, for example, can have a circular, semicircular, or elliptical shape. Similarly, first and/or second attachment zones 30, 32 for use in carrying a dagger, for example, can have a triangular shape. Variation in the application generally results also in an analogous change in the shape of retainer 160 (see FIGS. 2A, 2C, and 2D).

In the exemplary embodiment, obtuse angle 142 is approximately one-hundred-ten degrees (110°). An obtuse angle 142 of approximately one hundred ten degrees (110°) aligns retainer 160 such that retainer opening 192 is directed toward pocket opening 70, thereby facilitating removal by the wearer of the object (e.g., handgun magazine) retained in retainer 160. Depending on the application and/or the location of second attachment zone 32 in second region 92, however, obtuse angle 142 may range from approximately ninety-five degrees (95°) to approximately one-hundred-thirty-five degrees (135°) and, more preferably, from approximately one hundred degrees (100°) to approximately one-hundred-twenty degrees (120°). Obtuse angle 142 may also vary with the configuration of pocket opening 70. In one embodiment, acute angle 120 of first attachment zone 30 can be supplementary to obtuse angle 142 of second attachment zone 32, as shown in the exemplary embodiment. Accordingly, any retainers 160 attached respectively to first attachment zone 30 and second attachment zone 32 will be similarly oriented toward pocket opening 70.

Figure 2A:
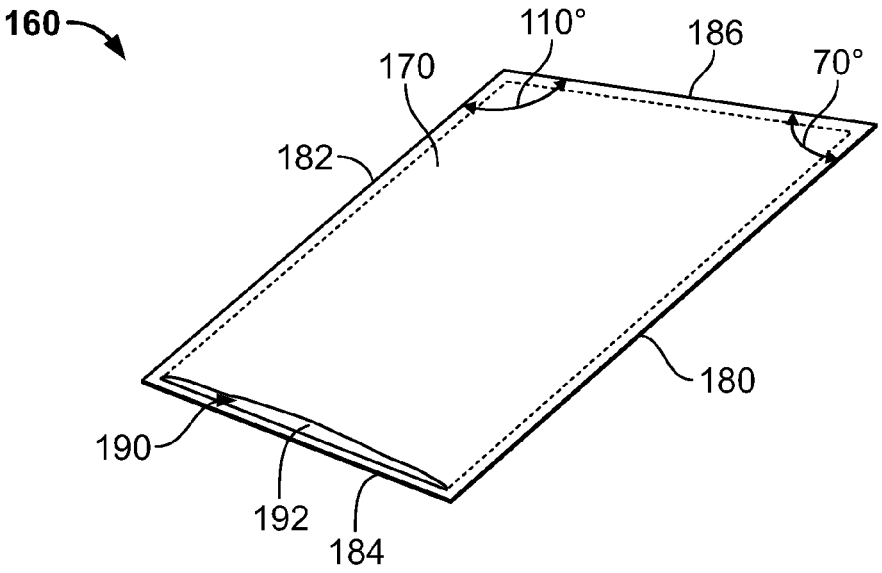
FIG. 2A is a top perspective view of a retainer for use with the garment pocket shown in FIGS. 1A and 1B.
Figure 2B:
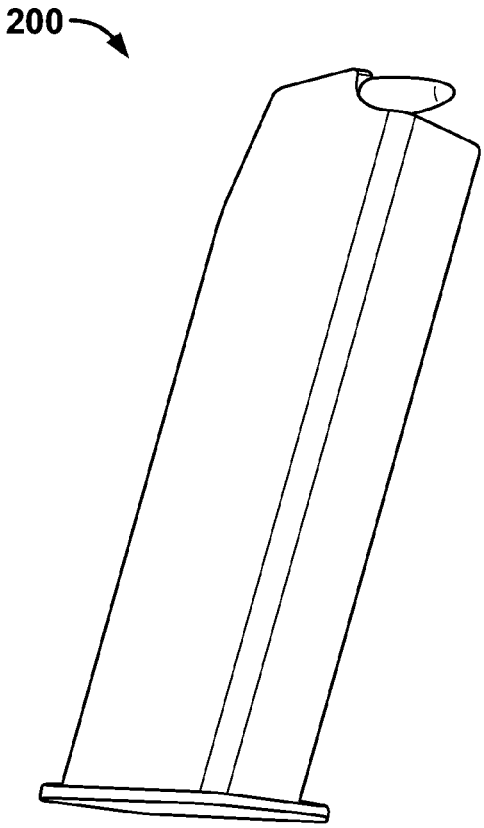
FIG. 2B is a perspective view of an exemplary handgun magazine.
Figure 2C:
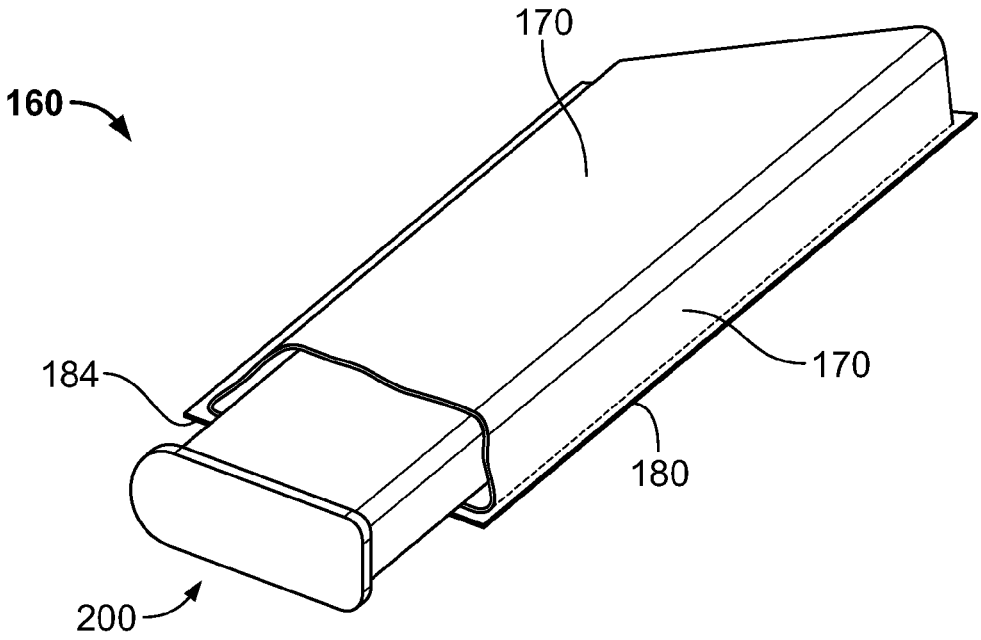
FIG. 2C is a top perspective view of the exemplary retainer shown in FIG. 2A retaining therein the exemplary handgun magazine shown in FIG. 2B.
Figure 2D:
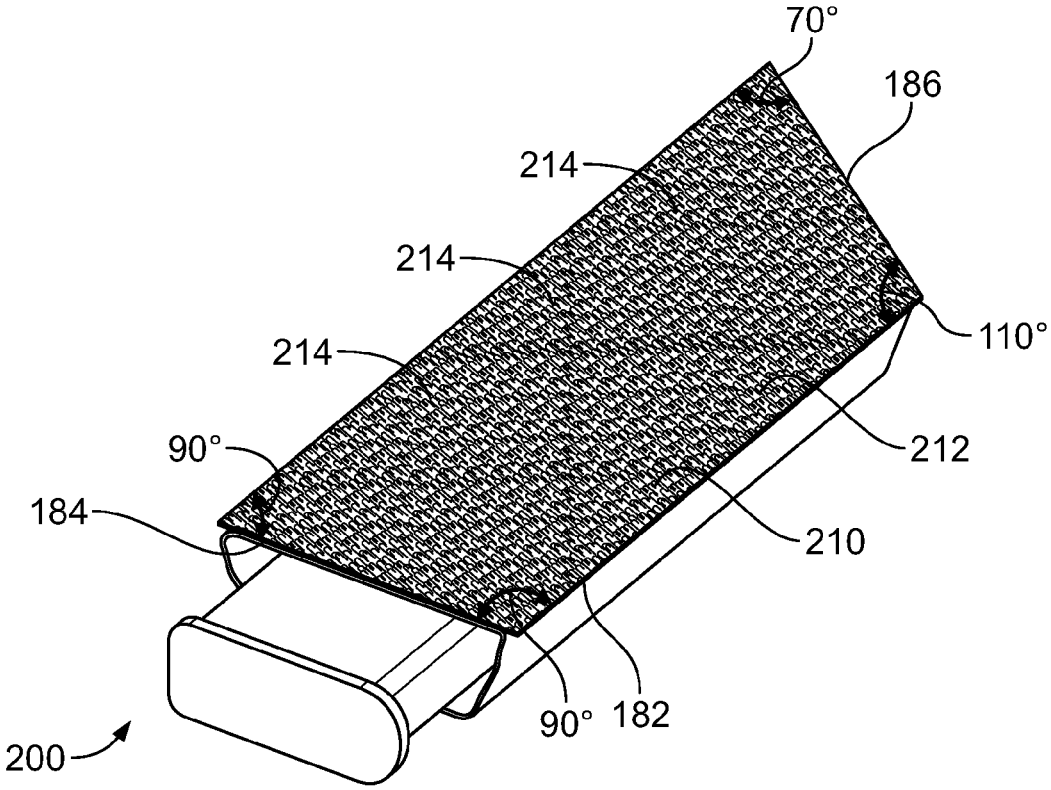
FIG. 2D is a bottom perspective view of the exemplary retainer shown in FIG. 2A retaining therein the exemplary handgun magazine shown in FIG. 2B.

FIGS. 2A-2D illustrate the structure and function of an exemplary retainer. FIG. 2A consists of a top perspective view of retainer 160 for use with the embodiment of pocket 10 shown in FIGS. 1A and 1B. More specifically, retainer 160 is suitable for attachment to either first attachment zone 30 or second attachment zone 32. Retainer 160 includes a first layer 170 and a second layer 210 (see FIG. 2D). First layer 170 is fastened (e.g., seamed or sewn) to second layer 210 along first parallel side 180 and second parallel side 182, and (optionally) along non-perpendicular (or fourth) side 186. First layer 170 is not fastened to second layer 210 along perpendicular (or third) side 184 in order to form a retainer opening 190 along perpendicular side 184, which provides access to a partially enclosed space 192 located between first layer 170 and second layer 210. Retainer 160 is configured to receive in partially enclosed space 192 at least a portion of a handgun magazine, for example, the exemplary nine millimeter (9 mm) handgun magazine 200 shown in FIG. 2B. First layer 170 of exemplary retainer 160 incorporates an elastic fiber (e.g., spandex, Lycra®) and, therefore, is elastic. Accordingly, as handgun magazine 200 is inserted in retainer 160 by way of retainer opening 190, first layer 170 expands in response to the contact force being exerted thereon by handgun magazine 200. Thus, the volume of partially-enclosed space 192 increases, enabling retainer 160 to retain at least a portion of handgun magazine 200 in position in partially-enclosed space 192. In an expanded state, first layer 170, which is elastic, exerts a compressive force on handgun magazine 200 to aid in retaining it in retainer 160. FIG. 2C, which is a top perspective view of handgun magazine 200 retained in retainer 160, shows first layer 170 in an expanded state. Second layer 210 is shown in FIG. 2D, which is a bottom perspective view of handgun magazine 200 retained in retainer 160. Second layer 210 includes an exterior surface 212 that includes a plurality of hook-type fasteners 214, which enable retainer 160 to be releasably attached to either first attachment zone 30 or second attachment zone 32. In another embodiment loop-type fasteners may be used on exterior surface 212, provided that hook-type fasteners are present in first attachment zone 30, second attachment zone 32, or both. Alternatively, a non-hook and loop-type fastener system (e.g., snaps, adhesives) may be used between or among retainer(s) 160, first attachment zone 30, and/or second attachment zone 32. In still other embodiments, the area of first attachment zone 30 or second attachment zone 32, respectively, can be increased (or otherwise configured) to enable the attachment of two or more retainers 160 thereto, or to provide the wearer additional options in locating and/or orienting a (single) retainer 160 within first attachment zone 30 or second attachment zone 32, respectively. In some of these embodiments and in still other embodiments, first attachment zone 30 (or second attachment zone 32) may partially extend into second region 92 (or first region 90) and/or third region 94 and/or fourth region (the remaining quadrant). In still another embodiment, first layer 170 is instead fastened (e.g., seamed or sewn) directly to either inner part (e.g., inner layer 290 (see FIG. 5)) or outer layer 20 to form the retainer or retaining device, thus eliminating second layer 210. In this embodiment, the retainer or retaining device is consequently permanently attached to the pocket and, accordingly, is not releasably attached thereto.

Figure 3:
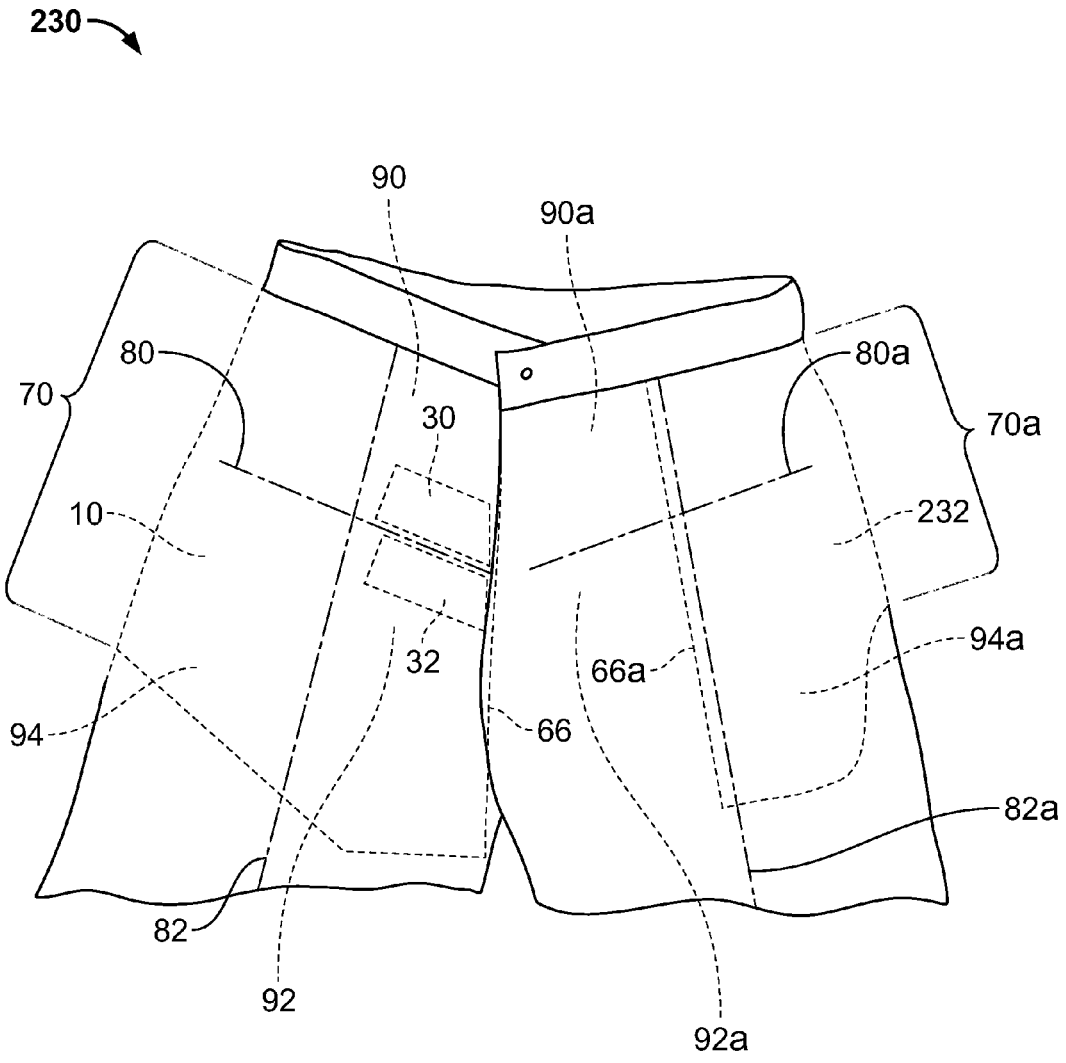
FIG. 3 is a partial front view of a pair of pants having the exemplary embodiment of the garment pocket shown in FIGS. 1A and 1B incorporated therein.

FIG. 3 is a partial front view of a pair of pants 230 having pocket 10 incorporated therein. Specifically, pocket 10 has been substituted for the right front pocket of pants 230. For purposes of comparison, FIG. 3 includes an approximate outline of a conventional left front pocket 232. As suggested by FIG. 3, even a relatively large conventional front pocket, such as left front pocket 232, does not allow for a handgun magazine (or other object) to be carried in first region 90*a* or second region 92*a*, which are the respective counterparts to first region 90 and second region 92 of pocket 10, because pocket 232 does not extend into first region 90*a* and/or second region 92*a*. Telegraphing of a handgun magazine (or other object) carried in conventional left front pocket 232 is more likely because, inter alia, the handgun magazine (or other object) would not be retained in first region 90*a* or second region 92*a* where the handgun magazine can be more easily concealed. Instead, the handgun magazine would be retained in third region 94*a*, which is the counterpart to third region 94 of pocket 10. In further contrast to pocket 10, conventional left front pocket 232 does not include any features for maintaining a handgun magazine (or other object) in a position and in an orientation that facilitates removal by the wearer.

Figure 4:
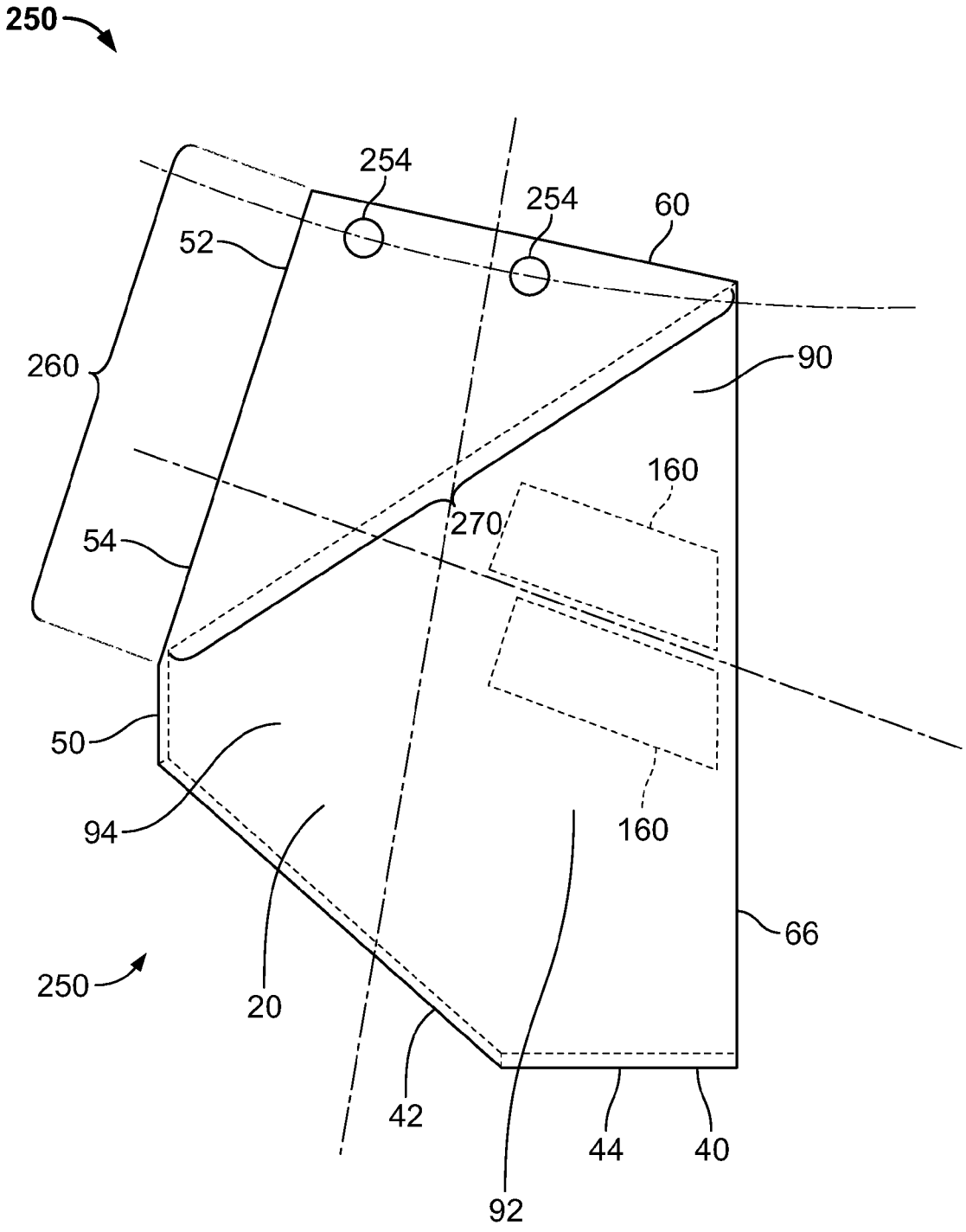
FIG. 4 is a schematic front plan view of another exemplary embodiment of the garment pocket of the present invention.

FIG. 4 is a schematic front plan view of another exemplary embodiment of the garment pocket of the present invention. Pocket 250, which is shown configured for access by a wearer's right hand, is intended for incorporation into a garment (e.g., pants, shorts, skirts). In an alternate embodiment, pocket 250 can be configured for access by a wearer's left hand. As in FIG. 1B, only outer part 20 is shown in FIG. 4 because outer part 20 and the corresponding inner part are substantially congruent. As in pocket 10, outer part 20 and the corresponding inner part may be formed from a single piece of pliable material. Referring to FIG. 4, outer part 20 is fastened (e.g., seamed or sewn) to the corresponding inner part at least along (1) first segment 40 and second segment 42 of base edge 44, and (2) segment 50 of outer edge 54. In contrast to pocket 10, outer part 20 of pocket 250 is not fastened to the inner part along top edge 60. Alternatively, outer part 20 and the corresponding inner part may be derived from two or more pieces of pliable material. In such instances, outer part 20 is additionally fastened to the corresponding inner part along inner edge 66.

In pocket 250, the corresponding inner part (but not outer part 20) can be fastened to the waistline of the garment along top edge 60. Similarly, the corresponding inner part (but not outer part 20) is intended to be fastened to the garment along segment 52 of outer edge 54, which coincides with unenlarged pocket opening 260 (explained below). Both outer part 20 and the corresponding inner part are intended to be fastened to the garment along segment 50 of outer edge 54. Outer edge 54 can be used to maintain pocket 10 in a proper position following incorporation into the garment, especially as pocket 250 generally is not fastened to the garment along inner edge 66 or base edge 44. Additionally, in pocket 250, outer part 20 is releasably fastened to the corresponding inner part along top edge 60 via readily-releasable fasteners 254 that are disguised or hidden within a flap in the garment that also serves as a waistband. As shown in FIG. 4, readily-releasable fasteners 254 are snaps; however, other readily-releasable fasteners, including (without limitation) hook and loop-type fasteners (e.g., Velcro®) may be used instead of, or in combination with, snaps. In another embodiment, outer part 20 can alternatively be releasably fastened to the corresponding inner layer along outer edge 54.

Pocket 250 is shown with an unenlarged pocket opening 260, which is comparable in size to a conventional pocket opening. The wearer can freely insert his hand into pocket 250 by way of unenlarged pocket opening 260 and grip an exemplary object (e.g., handgun magazine) carried therein in either of retainers 160. However, removal of the exemplary object from pocket 250 by way of unenlarged pocket opening 260 can be impeded because the size of the wearer's hand, when gripping the exemplary object, is greater than the size of the unenlarged pocket opening. Upon the release of readily-releasable fasteners 254, the opening of pocket 10 becomes enlarged pocket opening 270. Enlarged pocket opening 270 is significantly larger than unenlarged pocket opening 260. Enlarged pocket opening 270 is dimensioned such that the wearer can readily remove the exemplary object from pocket 250 because the size of enlarged pocket opening 270 is significantly greater than the size of the wearer's hand gripping the exemplary object. Aside from the presence of enlarged pocket opening 270 and the attendant modifications, pocket 250 is otherwise similar to pocket 10.

Figure 5:
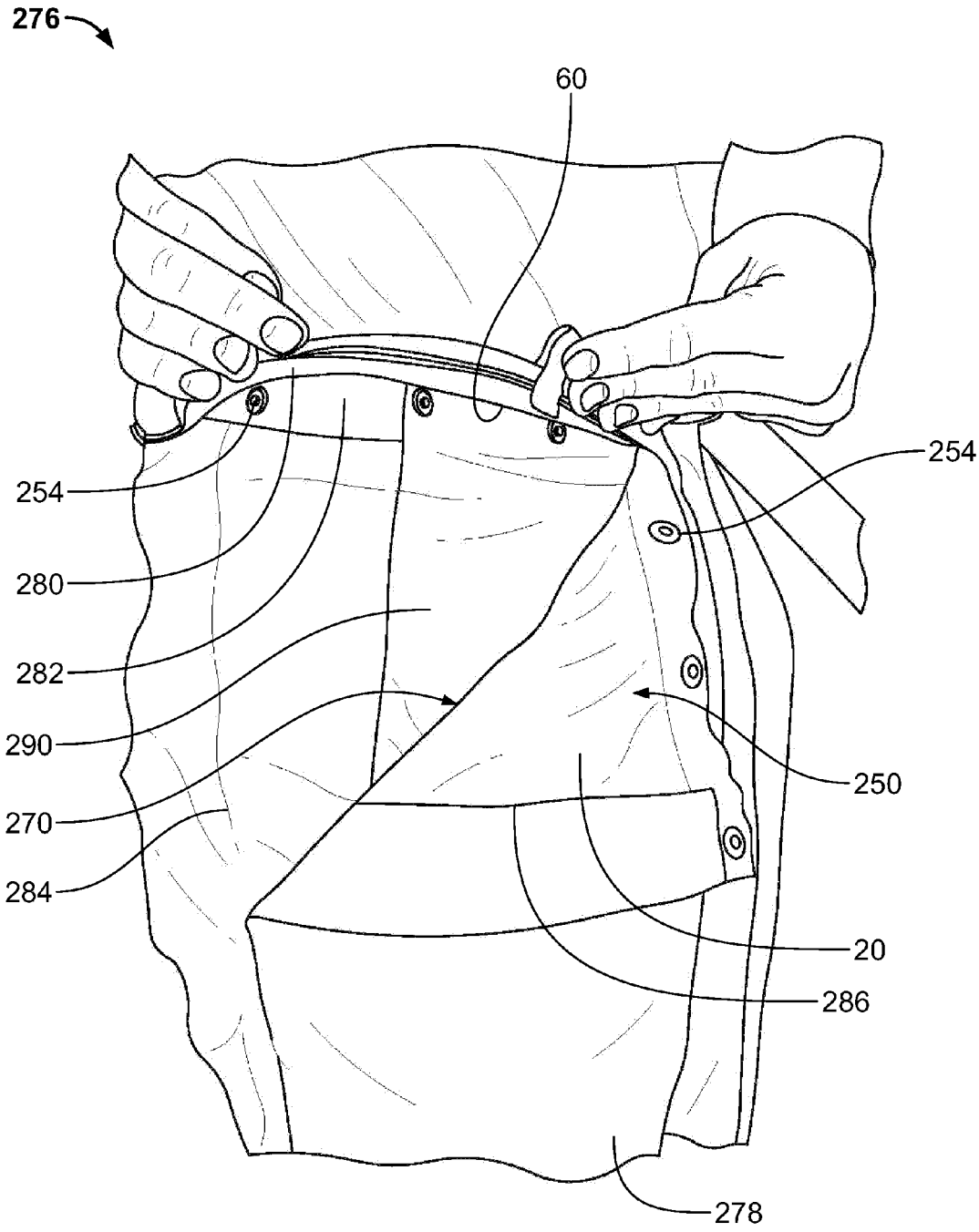
FIG. 5 is a side view of a wearer wearing pants having an exemplary embodiment of the garment pocket incorporated therein.

FIG. 5 is a side view of wearer 276 wearing pants 278 having pocket 250 incorporated therein. The opening of pocket 250 is shown in its enlarged state, i.e., enlarged pocket opening 270, as readily-releasable fasteners 254 are not fastened. As stated earlier, enlarged pocket opening 270 is dimensioned such that wearer 276 can readily remove an exemplary object (e.g., handgun magazine) from pocket 250. FIG. 5 also shows the relationship between inner layer 290 and outer part 20. The pre-existing seams of pants 278 can be used when incorporating pocket 250, to minimize the possibility that an observer will notice that pants 278 have been modified. For example, top edge 60 of inner layer 290 is fastened (e.g., seamed) along waistline 282 of pants 278, beneath beltline 280. When fastened, fasteners 254 are concealed by beltline 280, hiding the presence of a pocket opening that is enlargeable (see enlarged pocket opening 270). Additionally, there is no requirement that inner layer 290 and outer part 20 be congruent. As shown in FIG. 5, side edge 286 of outer part 20 extends further toward side seam 284 of pants 278 than does inner layer 290.

Figure 6:
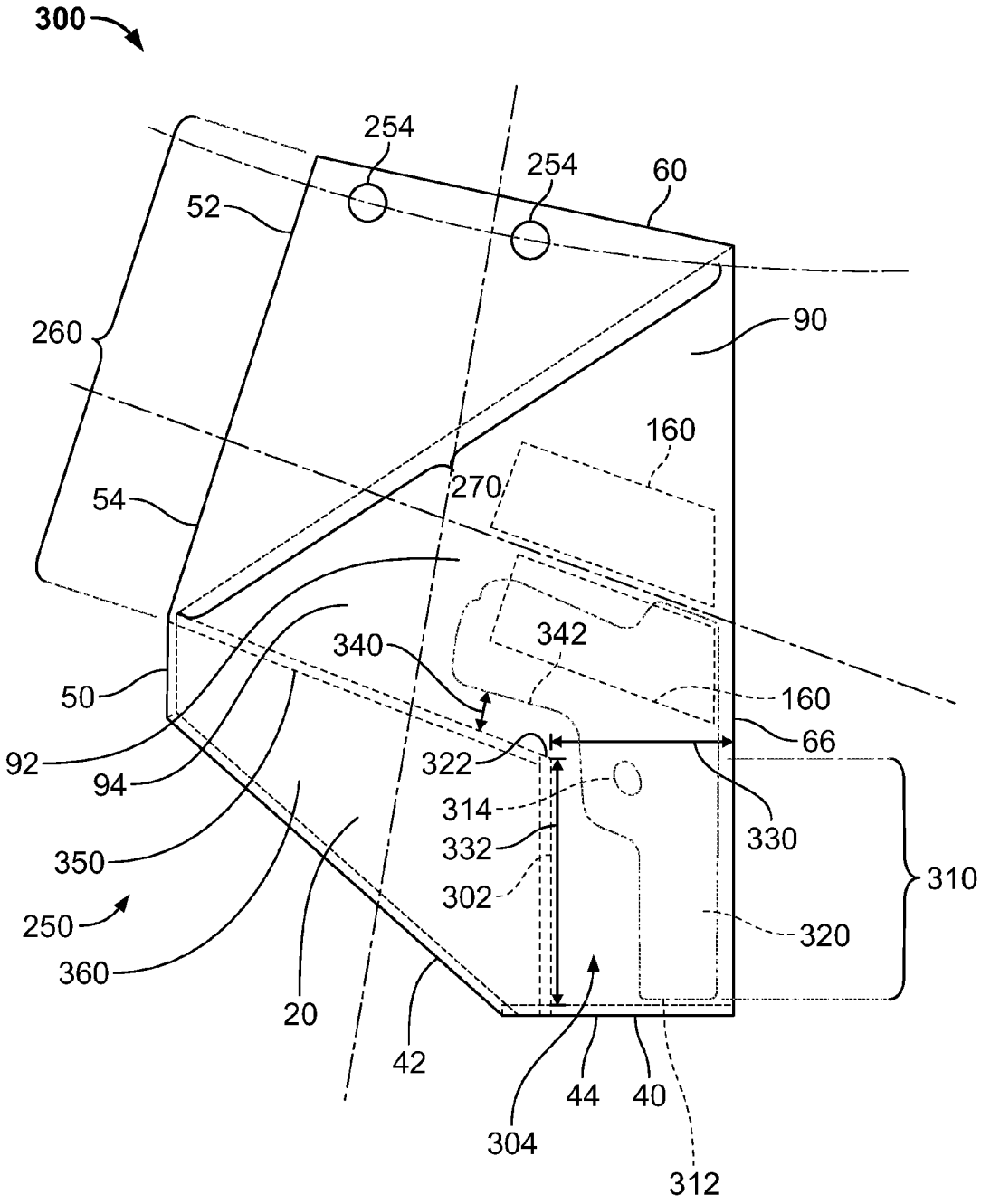
FIG. 6 is a schematic front plan view of yet another exemplary embodiment of the garment pocket of the present invention.

FIG. 6 is a schematic front plan view of another exemplary embodiment of the garment pocket of the present invention. Aside from the additional features described below, which are included for maintaining handgun 320 in proper orientation, pocket 300 is otherwise similar to pocket 250. In some embodiments, however, second attachment zone 32 and the corresponding retainer 160, both which are located in second region 92, are eliminated to allow sufficient space in the pocket for grip 342 and/or other portion of handgun 320. Pocket 300 includes first seam 302, which is substantially parallel to inner edge 66 and is substantially perpendicular to segment 40 of base edge 44. First seam 302, inner edge 66, and first segment 40 define receiving zone or partially-enclosed subspace 304, which is configured to receive barrel portion 310, muzzle 312, and trigger guard 314 of handgun 320. Receiving zone 304 is dimensioned to aid in maintaining handgun 32 in second region 92 and to provide an ergonomic orientation of handgun 320. Ergonomic orientation refers to one or more of (1) barrel portion 310 being substantially adjacent to inner edge 66; (2) muzzle 312 being substantially adjacent to first segment 40 of base edge 44; and/or (3) trigger guard 314 being proximal to the end of first seam 302 opposite base edge 44 (i.e., first end 322). Width 330 of receiving zone 304 is defined by the approximate distance between inner edge 66 and first seam 302. First seam 302 prevents movement of trigger guard 314 away from inner edge 66 to prevent handgun 320 (or a portion thereof) from entering third region 94. First seam 302 and inner edge 66 restrict lateral movement of handgun 320, maintaining barrel portion 310 in an orientation substantially adjacent to inner edge 66. If width 330 is too great, barrel portion 310 can move and not maintain such adjacent orientation. Conversely, if width 330 is too small, the wearer may experience difficulty in inserting barrel portion 310 and trigger guard 314 into receiving zone 304.

Height 332 of receiving zone 304 is defined by the approximate length of first seam 302. As shown in FIG. 6, the length of first seam 302 can be selected such that, once handgun 320 is inserted into receiving zone 304, the muzzle 312 of handgun 320 rests on base edge 44 and forms a finger gap 340 between grip 342 of handgun 320 and first end 322 of first seam 302. Finger gap 340 enables the wearer to grip and remove handgun 320 from pocket 300 more readily. The wearer, in preparing to remove handgun 320 from pocket 300, does not have to force his fingers between grip 342 and first end 322 of first seam 302 in order to grasp grip 342. Accordingly, finger gap 340 and the length of barrel portion 310 of handgun 320 are factors in selecting the length of first seam 302.

Pocket 300 could be modified to carry a handgun having a shorter barrel portion by shortening (1) first seam 302, or (2) first seam 302 and inner edge 66. Regarding the latter, the length of inner edge 66 will generally be shortened more than first seam 302 is shortened. Alternatively, pocket 300 could be modified to carry a handgun having a longer barrel portion by extending inner edge 66, first seam 302, and base edge 44 downward (i.e., in the direction of the wearer's knee), increasing height 332 of receiving zone 304. However, it is preferable that neither inner edge 66, first seam 302, nor base edge 44 is extended so far downward that they meet or intersect the line of flexion of corresponding to the wearer's knee joint.

Pocket 300 also includes second seam 350, which meets first end 322 of first seam 302 and segment 50 of outer edge 54. Second seam 350 can be provided to seal off adjoining zone 360, which includes part of second region 92 and part of third region 94. The second seam 350 can be configured to aid the wearer in correctly inserting barrel portion 310 of handgun 320 into receiving zone 304 by preventing the wearer from mistakenly inserting handgun 320 into adjoining zone 360.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A pocket for a garment comprising:
- a first portion; and
- a second portion connected to the first portion to form a partially-enclosed space accessible through a first opening, the partially-enclosed space comprising a region smaller than the partially-enclosed space;
- the region comprising a partially-enclosed subspace smaller than the region, the partially-enclosed subspace being defined by
  - an inner edge disposed proximate to an inseam of the garment;
  - a base edge extending substantially perpendicularly from the inner edge; and
  - a seam connecting the first portion and the second portion, the seam extending from the base edge in a direction substantially parallel to the inner edge and substantially perpendicular to the base edge, the seam being disposed in the partially-enclosed space and being configured and disposed to aid in orienting a first object in the partially-enclosed subspace;
- the partially-enclosed subspace being accessible through a second opening, the second opening being located opposite the base edge and extending between the seam and the inner edge;
- a retaining device positioned in the region at a location outside of the partially-enclosed subspace and near the second opening and the inner edge, the retaining device being operable to retain a handgun magazine in a fixed position in the retaining device; and
- the retaining device having a third opening to receive the handgun magazine and the retaining device being oriented to have the third opening be directed toward the first opening to facilitate removal of the handgun magazine from the retaining device by a wearer of the garment.

2. The pocket of claim 1, wherein the retaining device is disposed on the first portion.

3. The pocket of claim 1, wherein the retaining device is disposed on the second portion.

4. The pocket of claim 1, wherein the region is defined by
- a first line corresponding substantially to a line of flexion of a hip joint of the garment;
- a second line corresponding substantially to a centerline of a thigh of the garment;
- a third line corresponding approximately to an inseam of the garment; and
- a fourth line corresponding substantially to a line of flexion of a knee joint of the garment.

5. The pocket of claim 4, wherein the retaining device is positioned adjacent to the first line.

6. The pocket of claim 1, further comprising:
- the region has a first portion and a second portion;
- the retaining device is a first retaining device and is positioned in the first portion of the region;
- the second portion of the region is defined by
  - a first line corresponding substantially to a line of flexion of a hip joint of the garment;
  - a second line corresponding substantially to a centerline of a thigh of the garment;
  - a third line corresponding approximately to an inseam of the garment; and
  - a fourth line corresponding substantially to a waistline of the garment; and
- a second retaining device positioned in the second portion of the region, the second retaining device being configured and disposed to hold a third object in a fixed position in the partially enclosed space.

7. The pocket of claim 1, wherein the retaining device comprises a retainer and an attachment zone, the retainer being configured to releasably retain the handgun magazine.

8. The pocket of claim 7, wherein the retainer and the attachment zone are configured to enable the retainer to be repeatedly attached and detached from the attachment zone.

9. The pocket of claim 8, wherein the retainer includes the third opening and a second partially-enclosed space, the third opening being configured and disposed to provide access to the second partially-enclosed space, the retainer being configured to retain the handgun magazine at least partially within the second partially-enclosed space.

10. The pocket of claim 9, wherein the retainer comprises a first layer and a second layer attached to the first layer to form the second partially-enclosed space, the first layer comprising an elastic material to apply a compressive force against the handgun magazine to releasably retain the handgun magazine in the retainer.

11. The pocket of claim 10, wherein the retainer comprises:
- a first side and a second side parallel to the first side;
- a third side extending between the first side and the second side and positioned perpendicular to the first side and the second side;
- a fourth side extending between the first side and the second side and positioned opposite the third side; and
- the first layer is attached to the second layer along the first side, the second side and the fourth side.

12. The pocket of claim 11, wherein the third opening is positioned along the third side.

13. The pocket of claim 12, wherein the fourth side is not perpendicular to the first side and the second side.

14. The pocket of claim 13, wherein the fourth side is disposed proximate to an inseam of the garment.

15. The pocket of claim 7, wherein the attachment zone is directly connected to the first portion.

16. The pocket of claim 15, wherein the attachment zone comprises loop-type fasteners.

17. The pocket of claim 16, wherein the retainer comprises a first layer and a second layer attached to a first surface of the first layer.

18. The pocket of claim 17, wherein:
- the first layer has a second surface located opposite the first surface and the second layer;
- the second surface comprises hook-type fasteners; and
- the second layer comprises an elastic material to apply a compressive force against the handgun magazine to releasably retain the handgun magazine in the retainer.

19. The pocket of claim 8, wherein the retainer and the attachment zone are connected together using hook-type fasteners and loop-type fasteners.

20. The pocket of claim 7, wherein the retaining device comprises a plurality of retainers and a plurality of corresponding attachment zones.

21. The pocket of claim 7, wherein the retainer and the attachment zone have substantially congruent shapes.

22. The pocket of claim 7, wherein the retainer comprises a first side and a second side parallel to the first side.

23. The pocket of claim 22, wherein the retainer comprises a third side extending between the first side and the second side and positioned perpendicular to the first side and the second side.

24. The pocket of claim 23, wherein the retainer comprises a fourth side extending between the first side and the second side and positioned opposite the third side.

25. The pocket of claim 24, wherein the fourth side is not perpendicular to the first side and the second side.

26. The pocket of claim 1, wherein the retaining device comprises a retainer directly connected to the first portion, the retainer comprises an elastic material to apply a compressive force against the handgun magazine to releasably retain the handgun magazine in the retainer.

* * * * *